US006227622B1

(12) United States Patent
Roderick et al.

(10) Patent No.: US 6,227,622 B1
(45) Date of Patent: May 8, 2001

(54) MULTILAYER SKATE WHEEL

(75) Inventors: John A. Roderick, Scituate, RI (US); Albert C. Chiang, Mystic, CT (US); James A. Vandergrift, Seattle, WA (US)

(73) Assignee: K-2 Corporation, Vashon, WA (US)

( * ) Notice: Subject to any disclaimer, the term of this patent is extended or adjusted under 35 U.S.C. 154(b) by 0 days.

(21) Appl. No.: 08/879,951

(22) Filed: Jun. 20, 1997

(51) Int. Cl.[7] ..... B60B 7/10
(52) U.S. Cl. ..... 301/5.3; 152/323
(58) Field of Search ..... 301/5.3, 5.7, 64.7; 152/323, 393, 246; 280/11.22, 11.23

(56) References Cited

U.S. PATENT DOCUMENTS

| | | | | |
|---|---|---|---|---|
| 271,785 | | 2/1883 | Burton . | |
| 338,576 | | 3/1886 | Whitzel . | |
| 1,424,134 | * | 7/1922 | Litchfield | 152/393 X |
| 1,795,821 | | 3/1931 | Baldwin . | |
| 2,241,685 | * | 5/1941 | Ware | 301/5.3 |
| 2,717,808 | | 9/1955 | Owsen et al. . | |
| 3,287,023 | | 11/1966 | Ware . | |
| 3,408,770 | | 11/1968 | Smolinski et al. . | |
| 4,033,395 | * | 7/1977 | Berg et al. | 152/327 X |
| 4,208,073 | | 6/1980 | Hechinger . | |
| 4,273,345 | | 6/1981 | Ben-Dor et al. . | |
| 4,294,491 | | 10/1981 | Black . | |
| 4,699,432 | | 10/1987 | Klamer . | |
| 5,028,058 | | 7/1991 | Olson . | |
| 5,069,462 | | 12/1991 | Murga . | |
| 5,129,709 | | 7/1992 | Klamer . | |
| 5,135,244 | | 8/1992 | Allison . | |
| 5,171,032 | | 12/1992 | Dettmer . | |
| 5,183,275 | | 2/1993 | Hoskin . | |
| 5,197,572 | | 3/1993 | Roberts . | |
| 5,207,438 | | 5/1993 | Landers . | |
| 5,308,152 | | 5/1994 | Ho . | |
| 5,362,075 | | 11/1994 | Szendel . | |
| 5,393,078 | | 2/1995 | Bourdeau . | |
| 5,401,037 | | 3/1995 | O'Donnell et al. . | |
| 5,429,165 | * | 7/1995 | Ichikawa et al. | 152/323 X |
| 5,470,086 | | 11/1995 | Peterson et al. . | |
| 5,503,466 | | 4/1996 | Lew . | |
| 5,513,861 | | 5/1996 | Monroy et al. . | |
| 5,560,685 | * | 10/1996 | De Bortoli | 301/5.3 |
| 5,579,818 | * | 12/1996 | Hoppenheit et al. | 152/393 |
| 5,630,891 | * | 5/1997 | Peterson et al. | 301/5.3 X |
| 5,853,225 | * | 12/1998 | Huang | 301/5.3 |
| 5,860,707 | * | 1/1999 | Keleny | 301/5.3 |
| 5,908,519 | * | 6/1999 | Piper et al. | 152/327 X |
| 5,922,151 | * | 7/1999 | Piper et al. | 301/5.3 X |

FOREIGN PATENT DOCUMENTS

| | | |
|---|---|---|
| 0 714 682 A2 | 11/1995 | (EP) . |
| WO 96/34666 | 5/1996 | (WO) . |
| WO 97/17116 | 10/1996 | (WO) . |

* cited by examiner

*Primary Examiner*—Russell D. Stormer
(74) *Attorney, Agent, or Firm*—Christensen O'Connor Johnson Kindness PLLC

(57) ABSTRACT

A skate wheel and method of making the same are provided. The skate wheel includes multiple materials of differing durometers disposed on an inner hub. First, a solid or microcellular urethane is seated on an outer rim of the hub in a ring configuration around the rim. A urethane tire material surrounds the ring. The outer tire material is constructed preferably of a urethane that is more durable and harder than the ring. The ring is made of a highly resilient urethane for high speed. A wheel also is provided with energy absorption to counter rough road surfaces with less loss of energy by the skater, while increasing the traction of the skate wheel on the surface. A method is also provided of making a wheel by pouring differing resins into a mold and either spinning or separating the resins while allowing their interfaces to cure together for bonding therebetween.

9 Claims, 4 Drawing Sheets

MULTILAYER SKATE WHEEL

FIELD OF THE INVENTION

The present invention relates to wheels for skates such as in-line skates, quad roller skates, and skateboards, and more particularly to wheels with improved speed, shock absorption, vibration absorption, traction, and grip.

BACKGROUND OF THE INVENTION

Skate wheels ideally combine the attributes of resilience, wear resistance, and grip for a smooth ride on various paved surfaces without substantial energy loss and wheel wear. However, conventional in-line skate wheels, such as recreational, racing, and hockey wheels either have good vibration absorption but low wear resistance (soft wheel) or good wear resistance but low vibration absorption (hard wheel).

A skater's speed is also affected by the interaction between the wheel hardness and the roughness of the skating surface. A hard wheel will skate fast on a very smooth surface. However, as the surface becomes rougher, a soft wheel will more smoothly ride over small surface bumps and results in less skater energy loss. A hard wheel requires the skate to move vertically over bumps causing vibrations, extra movement of the wheel, and thus, extra energy expended.

Others have attempted to provide a wheel with improved dampening, resilience, and/or grip. For example, U.S. Pat. No. 4,699,432 (Klamer) discloses a dual material wheel. The surface of the wheel exposes the two materials including the softer material. However, such a wheel may be slow, having increased rolling friction. Furthermore, the soft material would not wear well and will create vibration due to the hardness on the skating surface.

SUMMARY OF THE INVENTION

The present invention includes a wheel that may be used for a skate such as an in-line skate, tandem skate, or skateboard. The wheel includes a hub, a tire circumscribing the hub, and at least one layer or ring between the hub and the tire. The tire is constructed of a first material. The ring is disposed at least partially between the hub and the tire. The ring is constructed of an elastomeric material softer than the first material of the tire construction.

Preferably, the hub includes a rim projecting radially outwardly therefrom. The rim has openings extending therethrough parallel to the rotational axis of the hub. The ring is disposed on the outer periphery of the rim with the tire extending beneath the rim through the openings. Preferably, the ring is in an at least slightly stretched state on the outer periphery of the rim.

The first material, from which the tire is constructed, preferably includes urethane. The elastomer ring or layer material includes a softer urethane than the first material. The ring material in one preferred embodiment includes a solid elastomer. In another preferred embodiment the ring material includes microcellular elastomer (e.g., polyurethane foam). Preferably, the first material includes a urethane with a Shore A hardness between 70A and 100A. The microcellular urethane ring has a density between 10 to 60 pounds per cubic foot. In the solid elastomer ring or layer embodiment, the hardness of the ring is between 20A to 75A on the Shore A scale. The ring's surface is rough so as to bond well to the urethane tire material.

The invention also encompasses a method of making a skate wheel including providing a hub, placing a ring of elastomeric foam around the outer periphery of the hub, placing the hub and the ring within a mold, and inserting tire material into the mold around the hub and ring. In one preferred embodiment of the invention, the ring comprises a microcellular urethane, while the tire material includes a solid elastomer. Preferably, the tire material is poured or cast into the mold.

In the preferred method of carrying out the invention, the hub includes a rim or other extensions projecting radially outwardly from the center portion of the hub and includes transverse openings through the rim. The ring is placed on the outer periphery of the rim or other projections and the tire material flows through the openings to substantially surround the ring. The ring preferably has a rough surface for positive mechanical bonding to the tire material. Alternatively, the tire material may be injected into the mold.

The present invention also encompasses an alternate method of making a dual durometer skate wheel. The skate wheel includes a rotational axis and the method includes placing first and second uncured resin materials in a wheel mold. The second material has a higher density than the first material. The mold is then spun about the rotational axis of the wheel to allow the second, higher density material to be concentrated generally at the outer periphery of the wheel mold. The first and second materials are at least partially mixed (B-stage process) at their interfaces for bonding therebetween. The first and second materials are then cured.

Preferably, at least one of the resin materials includes polyurethane. In one aspect of the preferred embodiment, the first and second materials are preferably poured into the mold.

An alternate method of the present invention includes making a dual durometer wheel by providing a wheel mold, placing a separator within the mold, inserting a first resin material on one side of the separator, inserting a second resin material on the other side of the separator, allowing at least one of the first and second materials to at least partially cure, removing the separator, and curing at least one of the first and second materials ("B-staging"). Preferably, a hub is provided inside both the first and second materials before inserting the materials into the mold. The first material is disposed adjacent the hub at an inner periphery and adjacent the separator at an outer periphery. The second material is adjacent the separator at an inner periphery.

The invention also includes a method of making an in-line skate wheel in a mold by spinning the mold on the axis of the wheel, placing a predetermined amount of first resin material into the mold, and placing a second resin material into the mold within the first material before the first material completely cures. The first material fills less than the complete volume of the mold to allow space for the second material within the first material. Preferably, the first material is allowed to gel before the second material is placed therewithin. Once allowed to gel, the rotation of the mold is stopped before adding the second material. Also, the preferred embodiment of the invention includes a hub inserted into the mold before the second material is placed therein. The hub is placed within the first material such that the second material is placed substantially between the hub and the first material.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings; wherein.

DETAILED DESCRIPTION OF THE PREFERRED EMBODIMENTS

Figure 1C:
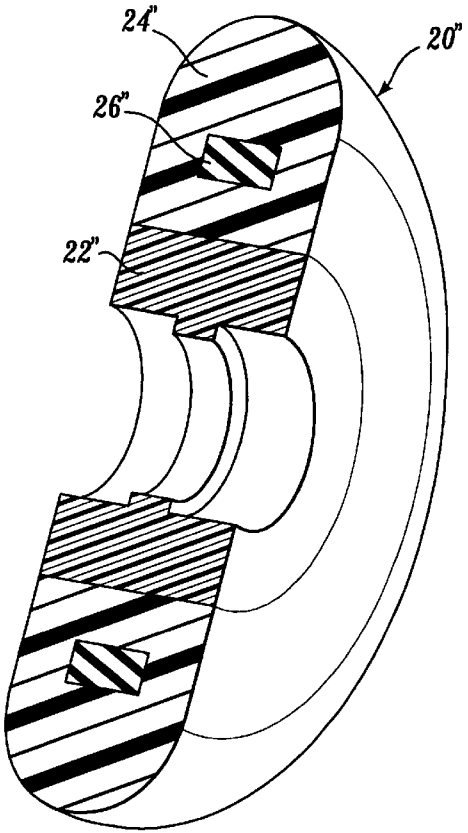
FIG. 1C is a sectional isometric view of another preferred embodiment of the present invention.
Figure 1B:
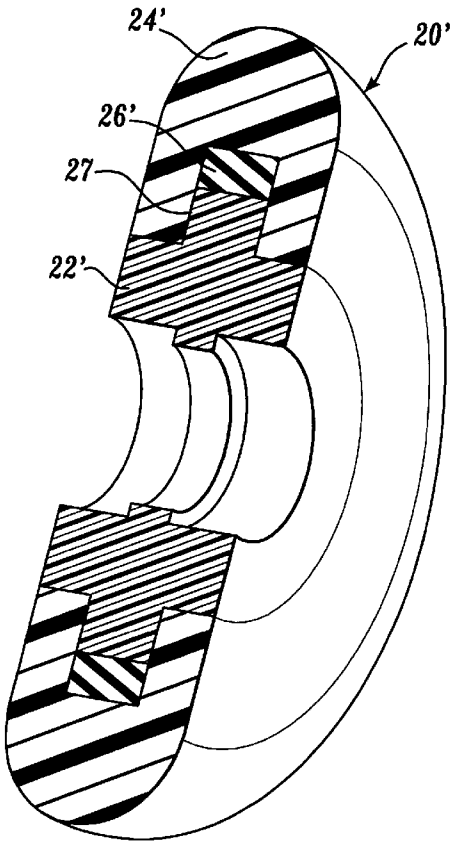
FIG. 1B is a sectional isometric view of another preferred embodiment of the present invention.
Figure 1A:
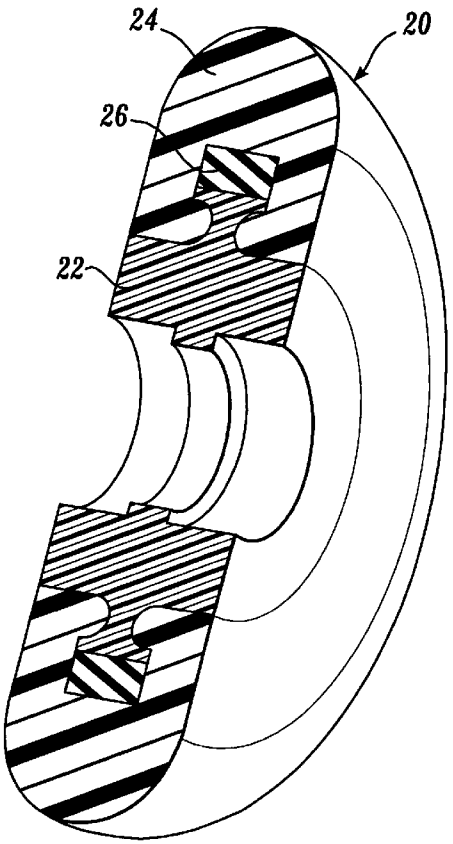
FIG. 1A is an isometric view of a wheel constructed according to the present invention, the wheel cut in half to display the internal construction.

The preferred construction of the dual or multiple durometer skate wheel of the present invention is illustrated in FIG. 1A. A wheel 20 includes a hub 22 at the central portion thereof Hub 22 includes conventional recesses within which the outer races of a set of bearings are disposed within the central portion or bore of hub 22. A tire 24 is secured to the outer periphery of hub 22. Tire 24 is preferably constructed of a polyurethane material, while hub 22 is preferably constructed of a thermoplastic urethane (TPU) material. As will be explained in more detail below, other materials such as nylon may alternatively be used.

A ring 26 is disposed between tire 24 and hub 22 and totally encapsulated thereby, in the preferred embodiment. Ring 26 extends around the outermost portion of hub 22 and is preferably held in place by tire 24, which is molded around both ring 26 and hub 22. The term "ring" as used throughout this description should be understood to include a layer extending at least partially beneath tire 24. The ring or layer could have various cross sections, widths, shapes, and diameters. It may lie flat against the hub or may float within the tire material removed from the hub as shown in FIG. 1C. Furthermore, ring 26 may be discontinuous such that it does not completely circumscribe or surround hub 22, as in FIG. 1B where multiple individual narrow projections 27 hold ring 26. Note that multiple rings or layers may also be used each having the same or differing densities or durometers.

Figure 2B:
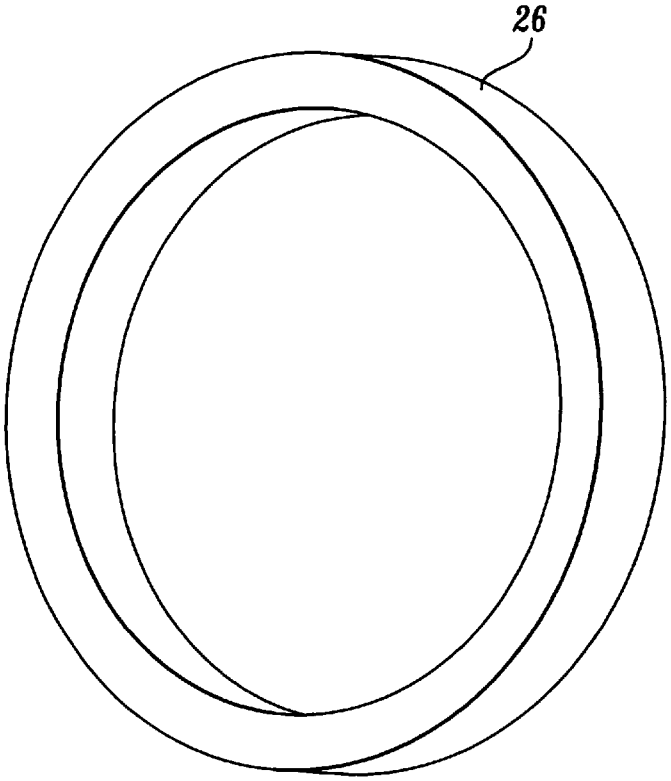
FIG. 2B is an isometric view of a ring of material held between the hub and outer tire member of the wheel.
Figure 2A:
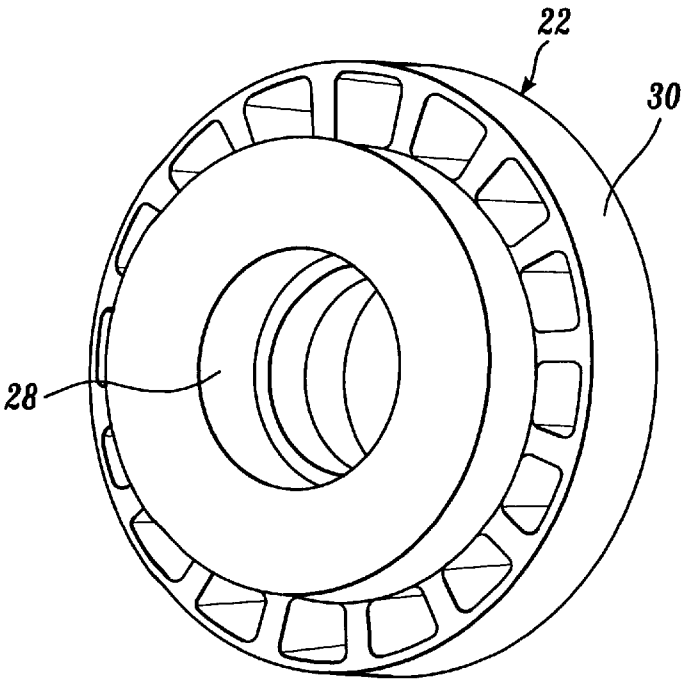
FIG. 2A is an isometric view of the hub used with the wheel illustrated in FIG. 1.

Further details of hub 22 are seen in FIG. 2A. Bearing recesses 28 are provided for placement of conventional skate bearings therein. Hub 22 includes rim 30 extending around the periphery thereof Rim 30 includes transverse openings therethrough through which tire 24 extends for secure mechanical attachment to hub 22.

Ring 26 is illustrated separately in FIG. 2B. Ring 26 is preferably snapped over the outer periphery of rim 30 to be held thereon once tire 24 is molded on hub 22 and rim 30. Preferably, ring 26 is formed separately from hub 22 and then placed thereon after being molded, cut, or otherwise formed. Ring 26 may consist of a solid elastomer material or a microcellular urethane (polyurethane foam) material. As mentioned above, the ring can vary in density, internal and external diameter, width, urethane formulation, spring rate, skin density (i.e., porosity) and air content. The microcellular or solid urethane is preferably a methylene diisocyanate (MDI), toluene diisocyanate (TDI), or a polyether- or polyester-based polyol or rubber or other soft material. However, other materials softer than tire 24 can be alternatively employed. An interface barrier can be used to enhance bonding between ring 26 and tire 24.

Once ring 26 is stretched over rim 30 of hub 22, hub 22 and ring 26 are placed within a mold used to form tire 24 therearound. Tire 24 is formed with a liquid resin injected or poured/cast into the mold and allowed to at least partially cure before being removed from the mold. The resin used to form tire 24 flows through the openings in rim 30 and also into any pores in the skin of hub 22 and in ring 26 for a mechanical bond therebetween. Additionally, chemical bonding can occur between ring 26 and tire 24 to secure their attachment to each other.

Figure 5:
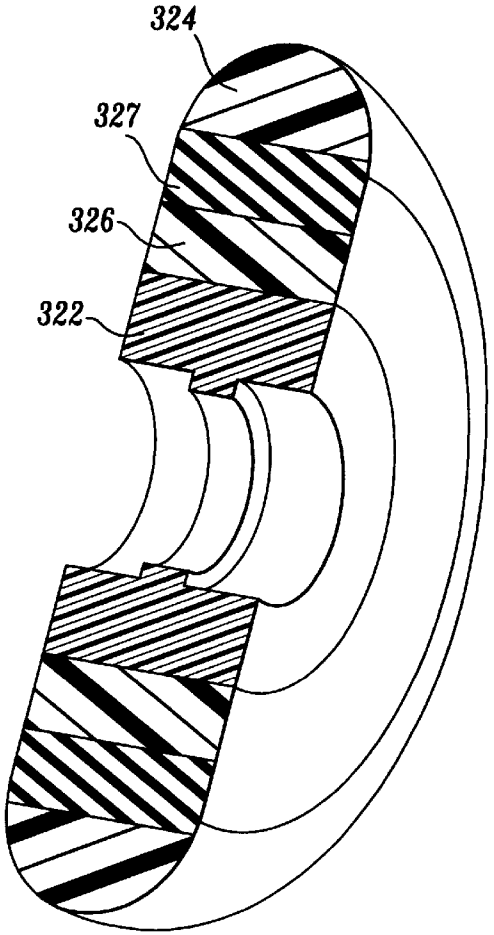
FIG. 5 is a sectional isometric view of another embodiment of the present invention having multiple durometer layers.

The above-described basic construction of wheel 20 can be used to construct wheels with greatly varying properties and uses by changing the sizes or materials used to construct the individual wheel components or by adding multiple rings or layers as shown in FIG. 5. Ring 26 is preferably constructed with a softer material than tire 24. Thus, ring 26 allows tire 24 to flatten or increase its footprint (area of the wheel that contacts the skating surface), thereby increasing the wheel's grip on the skating surface. At the same time, tire 24 is constructed of a harder material such that the rolling friction is not substantially increased with the increase in footprint. This allows the skater to turn sharply and skate faster, while the wheels maintain their grip on the skating surface.

Ring 26 also has a dampening effect while absorbing vibrations and shock for a more comfortable and efficient skate. By virtue of the softer nature of ring 26 relative to tire 24, ring 26 absorbs and dampens the vibrations to afford the skater an increased level of comfort on rough skating surfaces. The wheel can provide suspension action while carrying the dual properties of dampening and compressibility. The amount of air in ring 26 helps control the rebound of the wheel so that there is compression dampening from the microcellular urethane spring and rebound dampening from the internal compressed air. Using rings of varying internal and external diameters, as well as densities and materials, results in wheels with differing properties. Using multiple rings also gives the wheel differing properties (e.g. apparent hardness and/or resilience).

The soft inner ring 26 may be magnitudes higher in resilience and rebound than conventional outer layers, such as tire 24, that come in contact with skating surfaces. If ring 26 were to contact a skating surface, it would have extremely poor abrasion resistance (wear) and rolling resistance; therefore, the skater would not be able to take advantage of its resilient properties. However, encasing ring 26 within tire 24 provides a wheel with the resilience contributed by ring 26 and higher wear, surface grip, and speed properties than the harder polyurethane tire 24 by itself A harder tire 24 may be employed with ring 26 while obtaining a tire with an "apparent" durometer and/or resilience (the resulting hardness and traction feel) that provides increased comfort and/or speed.

A racing or speed wheel may be created with the dual durometer combination by providing the ring 26 fabricated from a urethane material with a Bashore rebound of over 75% while the outer tire 24 may be made from a more durable urethane in the rebound range of 60–75%. Urethanes in this range generally have a hardness between 75A and 90A on the Shore A scale. The inner ring or layer would preferably be constructed from a highly resilient urethane solid made from a material in the 20–75 Shore A range. This dual durometer construction increases the speed of the wheel by decreasing the energy losses associated with typical high durometer wheels that ride up and over every small bump on rough pavement. The multiple durometer wheel, in contrast, allows the hard outer tire 24 to compress ring 26 when a small bump is encountered such that it does not require that the skater moves up and over the bump, but rather simply moves tire 24 over the bump relative to hub 22 and the rest of the skate and skater. In other words, the wheel conforms to ride fast over the surface. Thus, the skate wheel continues in more of a straight line forward course without as much vertical movement robbing energy from the skater.

The increased resilience of the dual durometer wheel also increases the speed of the wheel on smooth surfaces. A harder material can be used for tire 24 while maintaining the traction and feel (the apparent durometer) due to the use of ring 26.

A skate wheel with even higher suspension characteristics can also be created using the two-component concept. If ring 26 is made from microcellular urethane, the rebound will be significantly reduced; however, energy absorption will be greatly increased. This higher energy absorption allows the wheel to travel over rougher surfaces with less overall energy loss by the skater. The resonating action of conventional hard or soft wheels on rough surfaces, while having less energy loss in the tire itself, will have greater energy loss overall due to the resonation and the vibration of the frame/wheel system. Thus the conventional wheels will lose more energy than a less lively (i.e., more highly damped) wheel. The rougher the road surface, the damper the wheel must become to minimize energy loss during rolling. For example, a smooth sidewalk may not require significant additional damping, while a heavily coated ("chipcoated") surface may require ring 26 to employ a low density microcellular foam material.

Wheels with varied properties may be constructed depending on anticipated road surfaces. For example, for a rough highway, the outer tire material may be constructed of a polyurethane with a hardness somewhere between 75A and 90A, while using a ring of microcellular urethane with a density resulting in 45 pounds per square inch compressive force. Alternatively, if a wheel is to be used with rougher surfaces (i.e., heavy chipcoat), the outer tire may be constructed with 80A to 86A durometer polyurethane and ring 26 of a microcellular urethane with a density of 10 to 60 pounds per cubic foot. In other words, the outer tire can be optimized for wear resistance and speed, while the inner ring can be optimized for energy absorption and resilience depending on the surface.

Various alternate embodiments can be contemplated that utilize the multiple component system described above. For example, hub 22 may not include rim 30 in the same outwardly projecting configuration illustrated in FIG. 2A. Alternatively, ring 26 may fit into a recess in hub 22 or simply flat on the face of hub 22 along an inner portion of hub 22. Alternatively, ring 26 may extend the entire width of hub 22 and be bonded thereto with tire 24 bonded to the outer periphery of ring 26. In alternate embodiments, rim 30 may be discontinuous with portions over which ring 26 extends not contacting rim 30. Furthermore, ring 26 may simply sit above hub 22 without direct contact therewith, with ring 26 held in place while tire 24 is molded thereabout.

Figure 3:
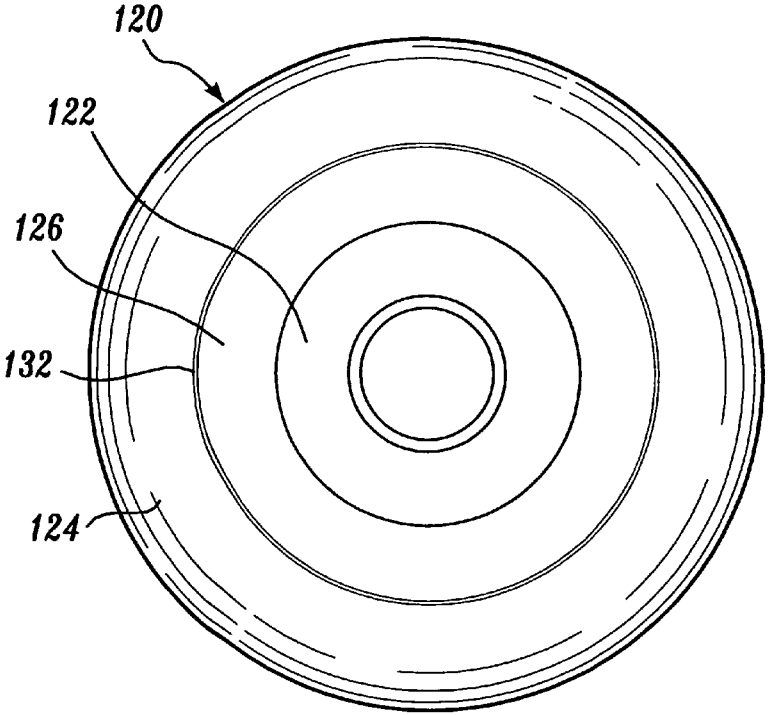
FIG. 3 is a sight elevational view of an alternate embodiment of the wheel of the present invention shown with a separator band.

FIG. 3 illustrates an alternate construction of a wheel 120 using multiple durometer materials. Hub 122 is surrounded by ring 126. Ring 126 is surrounded about its outer periphery by tire 124. In this embodiment of the invention, ring 126 extends through the entire width of wheel 120. However, alternate embodiments may include ring 126 extending only through a central portion of the width of wheel 120. A band 132 is illustrated in FIG. 3. Band 132 does not remain, preferably, in the finished wheel, but is used in the process of constructing the wheel. The wheel is constructed by pouring resins within a mold to form ring 126 and tire 124. Band 132 separates the resins while they are in a liquid state in order to maintain the higher durometer tire material about the outer periphery of wheel 120, while ring 126, with a softer lower durometer material, remains between tire 124 and hub 122. Once either tire 124 or ring 126 is cured to at least a gel state, band 132 can be removed while additional curing takes place and bonding between tire 124 and ring 126 occurs. In one embodiment of the method of constructing the wheel according to FIG. 3, band 132 may be secured in place and material for ring 126 poured about hub 122. After ring 126 reaches a gel or semi-cured state, band 132 could be removed and tire 124 could be poured and cured. Thereafter, ring 126 could finish curing and bond to tire 124 in the process. Alternatively, tire 124 may be poured first or both may be poured substantially simultaneously with band 132 in between. Band 132 is, preferably, a Teflon material with low surface friction such that it can smoothly be removed from between the resin materials. Silicone rings or bands may be used in place of Teflon bands since they would also have a low surface energy. Such a separator may be removed after substantially simultaneously pouring the ring and tire and following a waiting period of between 5 seconds and 5 minutes. Alternatively, separate molds may be used such that ring 126 is poured around hub 122 in a first mold, removed from the mold and placed in a second mold, after which tire 124 is poured thereabout. Ring 126, along with hub 122, may be removed from the first mold before complete curing of ring 126 so as to enhance the bond between ring 126 and tire 124.

Figure 4:
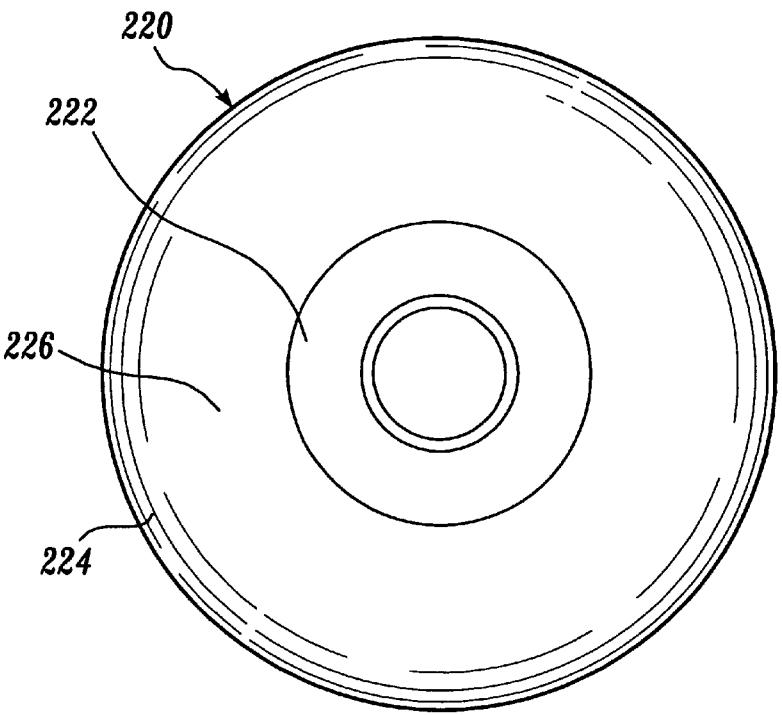
FIG. 4 is a side elevational view of an alternate embodiment of the wheel of the present invention with intermixed tire and ring materials.

FIG. 4 illustrates an alternate preferred embodiment of the wheel of the present invention constructed with another preferred method of the present invention. In this embodiment, spin casting is used to form the tire 224 of wheel 220. In this method, a predetermined amount of tire resin is placed within a mold. The mold is spun about the axis of hub 222 such that the resin forms a tire on the outside of the mold and that tire at least partially cures to substantially hold its shape. The spinning preferably takes place for from 5 seconds to 5 minutes in order to partially cure the resin. The spinning may then be stopped and the inner layer or ring 226 may be poured within the tire 224. Alternatively, a mixture of resins for ring 226 and tire 224 may be placed within a mold that is at the time spinning or is spun following the placement of the resins into the mold. The resin for ring 226 is of a lower density and thus the resin for tire 224 would move toward the outer periphery of wheel 220 while the resin for ring 226 remains between hub 222 and tire 224. However, since the resins were mixed, the bond between the two would be strong.

Alternatively, the resins are simply poured into the spinning mold at the same time without being previously mixed; the spinning of the mold would create a separation between them due to their diverse densities with adequate mixture at their interfaces while they cure. In another method of the invention, the tire 224 resin first is poured into the mold and spun for 5 seconds to 5 minutes for partial cure. The second material (less dense) for ring 226 is then poured into the mold or container and spun for 5 to 30 minutes under elevated temperatures. The temperatures may range from 80° to 260° Fahrenheit and the speed may vary from 500 to 5000 cycles per minute in the preferred embodiments of the inventions. The wheel is then demolded and post-cured for 8 to 12 hours at elevated temperatures. A temperature of 2200 Fahrenheit is preferred for post-curing.

While the preferred embodiments of the invention have been illustrated and described, it will be appreciated that various changes can be made therein without departing from the spirit and scope of the invention.

The embodiment of the invention in which an exclusive property or privilege is claimed is defined as follows:

1. A skate wheel comprising:

(a) a hub;

(b) a tire circumscribing said hub, said tire being constructed of a first material; and (c) a ring disposed at least partially between said hub and said tire, wherein said tire encapsulates said ring, said ring being constructed of a solid elastomer material softer than said first material.

2. The skate wheel of claim 1, further including a second ring disposed between said hub and said tire, said second ring having a different durometer than said tire.

3. The skate wheel of claim 1, wherein said hub includes a rim projecting radially outwardly therefrom, said rim having openings extending transversely therethrough, said ring being disposed around the outer periphery of said rim, said tire extending beneath id rim through said openings.

4. The skate wheel of claim 3, wherein said ring is in an at least slightly stretched state around the outer periphery of said rim.

5. The skate wheel of claim 1, wherein said first material comprises urethane and wherein said elastomer ring material comprises softer urethane.

6. The skate wheel of claim 5, wherein said ring material comprises a solid elastomer.

7. The skate wheel of claim 5, wherein said ring material comprises microcellular elastomer.

8. The skate wheel of claim 7, wherein the first material comprises a urethane having a Shore A hardness between 70A and 100A and wherein the ring has a density of between 10 to 60 pounds per cubic foot.

9. The skate wheel of claim 5, wherein said ring surface is rough.

* * * * *